US009605499B1

(12) United States Patent
Sun et al.

(10) Patent No.: US 9,605,499 B1
(45) Date of Patent: Mar. 28, 2017

(54) SUBSEA WELLHEAD PRESSURE INDICATING AND AUTOMATIC ADJUSTING DEVICE FOR DEEP-WATER DUAL-GRADIENT DRILLING

(71) Applicant: China University of Petroleum (East China), Qingdao, Shandong (CN)

(72) Inventors: Baojiang Sun, Shandong (CN); Zhennan Zhang, Shandong (CN); Zhiyuan Wang, Shandong (CN); Ning Wang, Shandong (CN); Xuerui Wang, Shandong (CN); Guomin Yan, Shandong (CN); Yang Zhao, Shandong (CN)

(73) Assignee: China University of Petroleum (East China), Shandong (CN)

( * ) Notice: Subject to any disclaimer, the term of this patent is extended or adjusted under 35 U.S.C. 154(b) by 0 days.

(21) Appl. No.: 15/258,504

(22) Filed: Sep. 7, 2016

(51) Int. Cl.
*E21B 7/128* (2006.01)
*E21B 21/08* (2006.01)
(Continued)

(52) U.S. Cl.
CPC ..... *E21B 21/001* (2013.01); *E21B 7/128* (2013.01); *E21B 17/01* (2013.01); *E21B 21/01* (2013.01);
(Continued)

(58) Field of Classification Search
CPC ..... E21B 7/128; E21B 17/01; E21B 21/001; E21B 21/01; E21B 21/08; E21B 21/106;
(Continued)

(56) References Cited

U.S. PATENT DOCUMENTS 3,603,409 A * 9/1971 Watkins ..... E21B 7/128 166/352
6,457,529 B2 * 10/2002 Calder ..... E21B 21/001 166/368

(Continued)

FOREIGN PATENT DOCUMENTS

CN 104895548 9/2015

*Primary Examiner* — Matthew R Buck
(74) *Attorney, Agent, or Firm* — Calfee, Halter & Griswold LLP

(57) ABSTRACT

The present invention relates to deep-water drilling in petroleum engineering and, in particular, to a subsea wellhead pressure indicating and automatic adjusting device for deep-water dual-gradient drilling, comprising a subsea drilling fluid manifold system and a subsea wellhead pressure indicating and automatic adjusting system, wherein the subsea drilling fluid manifold system provides a flow channel for the drilling fluid returning through the wellbore so that the drilling fluid can smoothly return to a drilling platform, and provides a basis for the subsea wellhead pressure indicating and automatic adjusting system; and wherein the subsea wellhead pressure indicating and automatic adjusting system can display and adjust the subsea wellhead pressure in real time, in order to keep the subsea wellhead pressure to be constantly equal to the hydrostatic pressure of the seawater at the seabed. The present invention makes it possible to keep the subsea wellhead pressure to be constantly equal to the hydrostatic pressure of the seawater at the seabed in an automatic and real-time way, ensuring successful implementation of the dual-gradient drilling.

8 Claims, 2 Drawing Sheets

(51) Int. Cl.

| | |
|---|---|
| ***E21B 21/00*** | (2006.01) |
| ***E21B 44/00*** | (2006.01) |
| ***E21B 21/10*** | (2006.01) |
| ***E21B 17/01*** | (2006.01) |
| ***E21B 33/035*** | (2006.01) |
| ***E21B 21/01*** | (2006.01) |
| ***E21B 43/08*** | (2006.01) |
| ***E21B 47/06*** | (2012.01) |

(52) U.S. Cl.
CPC ..... *E21B 21/106* (2013.01); *E21B 33/0355* (2013.01); *E21B 43/084* (2013.01); *E21B 44/00* (2013.01); *E21B 47/06* (2013.01)

(58) Field of Classification Search
CPC .... E21B 33/0355; E21B 43/084; E21B 44/00; E21B 47/06
See application file for complete search history.

(56) References Cited

U.S. PATENT DOCUMENTS

| | | | | |
|---|---|---|---|---|
| 8,978,774 | B2 * | 3/2015 | Fossli | E21B 21/001 166/347 |
| 9,316,054 | B2 * | 4/2016 | Weinstock | E21B 7/12 |
| 2015/0275602 | A1 * | 10/2015 | Kjosnes | E21B 33/085 175/25 |

* cited by examiner

SUBSEA WELLHEAD PRESSURE INDICATING AND AUTOMATIC ADJUSTING DEVICE FOR DEEP-WATER DUAL-GRADIENT DRILLING

TECHNICAL FIELD

The invention relates to deep-water drilling in petroleum engineering and, in particular, to a subsea wellhead pressure indicating and automatic adjusting device for deep-water dual-gradient drilling.

BACKGROUND

The development of the petroleum industry in China has been oriented to seas and oceans gradually. Especially, the efforts have been strengthened continuously in exploration and development of deep-water oil and gas fields in the South China Sea region. Offshore well drilling, especially deep-water well drilling, is confronted with a much harsher operating environment than the onshore well drilling. A prominent problem is the narrow "safe density window" incurred by the existence of seawater. To realize safe deep-water well drilling, the pressure in the wellbore must be controlled within the safe density window. Therefore, to make the pressure distribution in the wellbore closer to the two environmental pressure distributions (seawater pressure distribution above the mud line, and formation pressure distribution below the mud line) confronted in deep-water well drilling, new techniques such as dual-gradient offshore well drilling have been developed gradually, and have exhibited their obvious advantages in applications.

The key point in the wellbore pressure control in deep-water dual-gradient drilling is to keep the pressure distribution in the marine riser above the subsea wellhead to be equal to seawater hydrostatic pressure distribution and keep the pressure distribution in the wellbore below the subsea wellhead to be equal to formation pressure distribution, especially and, in particular, to ensure that the subsea wellhead pressure is equal to the hydrostatic pressure of seawater at the seabed. To implement deep-water dual-gradient drilling, special devices, such as rotary flow divider, etc., are installed at the subsea wellhead, so as to divide the wellbore into two parts: the upper part above the subsea wellhead is the marine riser part, and the lower part below the subsea wellhead is the wellbore part. As a result, spatial division is realized. However, the hydraulic system of the wellbore is also isolated, i.e., the marine riser part above the subsea wellhead is filled with seawater, while the wellbore part below the subsea wellhead is filled with drilling fluid. In this case, the pressure in the upper part and the pressure in the lower part of the cyclone separator are not equal to each other, which means the subsea wellhead pressure below the cyclone separator is not equal to the hydrostatic pressure of seawater at the seabed. Consequently, the detection and control of the internal pressure in the wellbore part are more difficult, and the accuracy of pressure control in deep-water dual-gradient drilling is decreased.

In addition, owing to the fact the seawater depth varies with time during drilling, the hydrostatic pressure of seawater at the seabed also varies with time. The monitoring of the pressure at the seabed is difficult owing to the existence of seawater, further affecting the accuracy of wellbore pressure control in dual-gradient drilling. Hence, it is necessary to design a device that can monitor the pressure at the seabed, keep the subsea wellhead pressure equal to the hydrostatic pressure of seawater at the seabed in real time and provide parameters for smooth operation of the subsea mud pump, with reference to the environmental characteristics of the deep-water well drilling.

SUMMARY

To meet the requirement for safe drilling in exploration and development of deep-water oil and gas reservoirs, the present invention provides a subsea wellhead pressure indicating and automatic adjusting device for deep-water dual-gradient drilling, which can keep the subsea wellhead pressure to be constantly equal to the hydrostatic pressure of seawater at the seabed, and can indicate the pressure at a subsea wellhead in real time to provide a reference for the operators.

To solve the above-mentioned technical problem, the present invention provides a subsea wellhead pressure indicating and automatic adjusting device for deep-water dual-gradient drilling, comprising: a subsea drilling fluid manifold system and a subsea wellhead pressure indicating and automatic adjusting system, wherein the subsea drilling fluid manifold system provides a flow channel for the drilling fluid returning through the wellbore so that the drilling fluid can smoothly return to a drilling platform, and provides a basis for the subsea wellhead pressure indicating and automatic adjusting system; and wherein the subsea wellhead pressure indicating and automatic adjusting system can display and adjust the subsea wellhead pressure in real time, and keep the subsea wellhead pressure to be constantly equal to the hydrostatic pressure of the seawater at the seabed, ensuring successful implementation of the dual-gradient drilling.

Compared with the prior art, the present invention has the following beneficial effects:

(1) the subsea wellhead pressure is kept to be constantly equal to the hydrostatic pressure of seawater at the seabed in real time;

(2) the device is simple in structure and easy to implement, eliminating the need for additional monitoring from the drilling platform or the need for a control device or control operations;

(3) the device improves the accuracy of pressure control in the wellbore below the rotating blowout preventer for dual-gradient drilling, facilitating safe and efficient drilling.

The reference signs in the figures are explained as follows: 100—subsea wellhead pressure indicating and automatic adjusting device for deep-water dual-gradient drilling; 101—first tee joint; 102—first flat gate valve; 103—second flat gate valve; 104—first pressure gauge; 105—second tee joint; 106—third tee joint; 107—hydraulic throttle valve; 108—check valve; 110—second pressure gauge; 109—subsea mud pump; 201—rock cuttings filter; 202—subsea pressure controller; 2021—subsea pressure controller casing; 2022—lower slider; 2023—spring; 2024—piston; 2025—upper slider; 2026—subsea wellhead pressure indicator; 2027—pressure chamber; 203—pressure booster; 301— floating drilling platform; 302—marine riser; 303—drilling stein; 304—subsea wellhead device; 305—drill bit; 306—drilling fluid discharge pipeline; 307—drilling fluid return pipeline

DETAILED DESCRIPTION OF THE EMBODIMENTS

Figure 1:
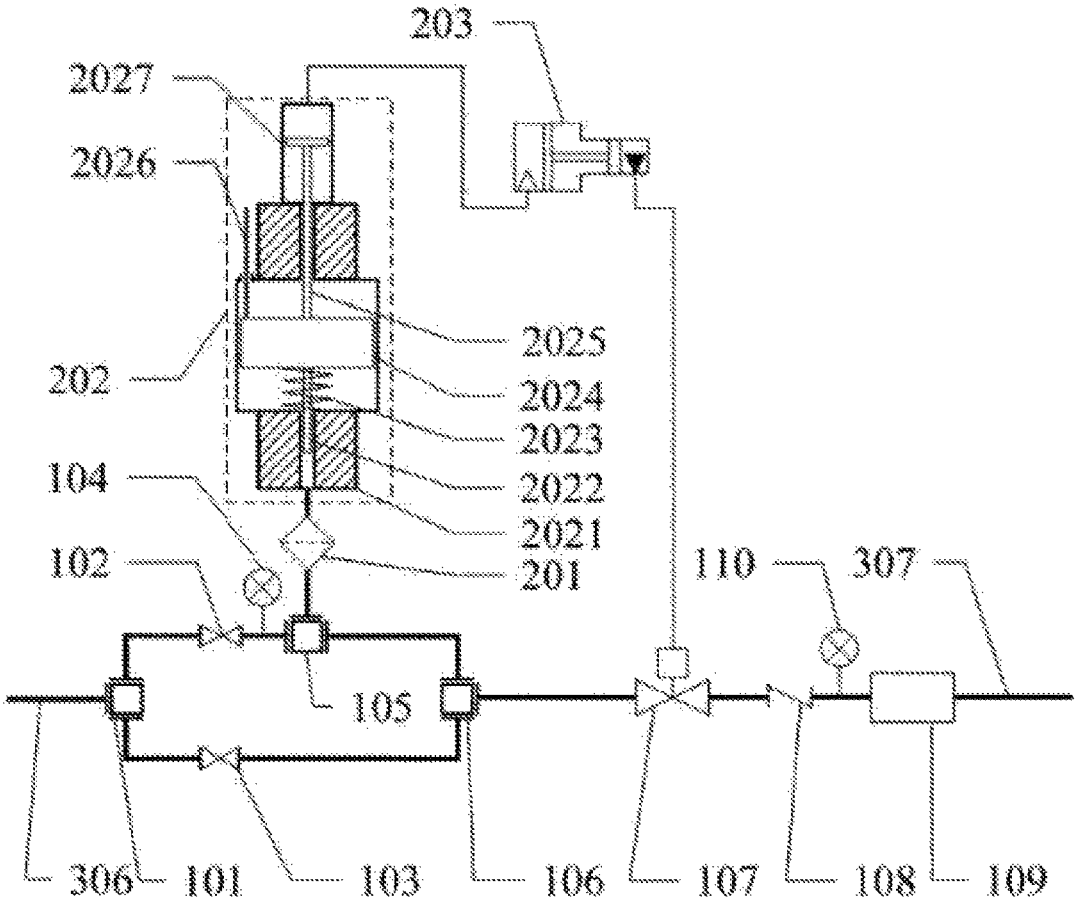
FIG. 1 is a schematic diagram of the subsea wellhead pressure indicating and automatic adjusting device for deep-water dual-gradient drilling.

As shown in FIG. 1, the subsea wellhead pressure indicating and automatic adjusting device for deep-water dual-gradient drilling 100 comprises: a subsea drilling fluid manifold system and a subsea wellhead pressure indicating and automatic adjusting system, the subsea drilling fluid manifold system provides a flow channel for the drilling fluid returning through the wellbore so that the drilling fluid can smoothly return to a drilling platform, and provides a basis for the subsea wellhead pressure indicating and automatic adjusting system; the subsea wellhead pressure indicating and automatic adjusting system can display and adjust the subsea wellhead pressure in real time, and keep the subsea wellhead pressure to be constantly equal to the hydrostatic pressure of the seawater at the seabed, ensuring successful implementation of dual-gradient drilling.

The subsea drilling fluid manifold system comprises: a first tee joint 101, a first flat gate valve 102, a second flat gate valve 103, a first pressure gauge 104, a second tee joint 105, a third tee joint 106, a hydraulic throttle valve 107, a check valve 108, a subsea mud pump 109, and a second pressure gauge 110, wherein, an inlet of the first tee joint 101 is connected to a subsea wellhead device 304 through a drilling fluid discharge pipeline 306, a first outlet of the first tee joint 101 is connected to an inlet of the first flat gate valve 102 through a pipeline, an outlet of the first flat gate valve 102 is connected to an inlet of the second tee joint 105 through a pipeline on which the first pressure gauge 104 is arranged, and a first outlet of the second tee joint 105 is connected to a first inlet of the third tee joint 106 through a pipeline; a second outlet of the first tee joint 101 is connected to an inlet of the second flat gate valve 103 through a pipeline, and an outlet of the second flat gate valve 103 is connected to a second inlet of the third tee joint 106 through a pipeline; an outlet of the third tee joint 106 is connect to a fluid inlet of the hydraulic throttle valve 107 through a pipeline, a fluid outlet of the hydraulic throttle valve 107 is connected to an inlet of the check valve 108 through a pipeline, an outlet of the check valve 108 is connected to an inlet of the subsea mud pump 109 through a pipeline on which the second pressure gauge 110 is arranged, and an outlet of the subsea mud pump 109 is connected to a floating drilling platform 301 through a drilling fluid return pipeline 307; the first tee joint 101 implements a branch from the drilling fluid discharge pipeline 306; the first flat gate valve 102 controls whether the pipeline on which it is mounted is a flowing pipeline, i.e., the pipeline is a flowing pipeline when the first flat gate valve 102 is in open state, and is a non-flowing pipeline when the first flat gate valve 102 is in closed state, the first flat gate valve 102 may be opened/closed by means of an underwater robot; the first pressure gauge 104 displays the subsea wellhead pressure, which may be observed by means of the underwater robot; the second tee joint 105 separates an incoming pipeline into two outgoing pipelines, while the third tee joint 106 merges two incoming pipelines into an outgoing pipeline; the second flat gate valve 103 controls whether the pipeline on which it is mounted is a flowing pipeline, i.e., the pipeline is a flowing pipeline when the second flat gate valve 103 is in open state, and is a non-flowing pipeline when the second flat gate valve 103 is in closed state; the second flat gate valve 103 may be opened/closed by means of the underwater robot; the hydraulic throttle valve 107 is provided with a hydraulic control unit, and the opening of the hydraulic throttle valve 107 is controlled by the subsea wellhead pressure indicating and automatic adjusting system, so that the drilling fluid flow and the throttle pressure drop can be controlled by adjusting the opening of the hydraulic throttle valve 107; the check valve 108 presents backflow of the drilling fluid; the second pressure gauge 110 displays the inlet pressure of the pump, which can be observed by the underwater robot; the subsea mud pump 109 provides power to the returning drilling fluid, so that the drilling fluid can return through the drilling fluid return pipeline 307 to the floating drilling platform 301.

The subsea wellhead pressure indicating and automatic adjusting system comprises: a rock cuttings filter 201, a subsea pressure controller 202, and a pressure booster 203, wherein, an inlet of the rock cuttings filter 201 is connected to a second outlet of the second tee joint 105 through a pipeline, the rock cuttings filter 201 has a built-in filter screen, the mesh size of which is smaller than the particle size of the solid particles handled by a solid particle handler for deep-water dual-gradient drilling, so that the solid particles in the drilling fluid are filtered, to ensure no large-size solid particle will enter the cavity of the subsea wellhead pressure indicating and automatic adjusting system;

The subsea pressure controller 202 comprises a subsea pressure controller casing 2021, a lower slider 2022, a spring 2023, a piston 2024, an upper slider 2025, a subsea wellhead pressure indicator 2026, and a pressure chamber 2027, wherein, the upper end and the lower end of the subsea pressure controller casing 2021 have the same outer diameter, which is smaller than the outer diameter of the middle part of the subsea pressure controller casing 2021; the upper end and the lower end are arranged with a hole respectively for the upper slider 2025 and the lower slider 2022 to slide up and down, wherein the hole for the lower slider 2022 to slide forms the inlet of the subsea pressure controller 202; the inlet of the subsea pressure controller 202 is connected to the outlet of the rock cuttings filter 201; the inner diameter of the middle part is larger than the outer diameter of the upper end and of the lower end, the subsea pressure controller casing 2021 forms a main cavity of the subsea wellhead pressure indicating and adjusting device, the piston 2024 is arranged in the main cavity, and the main cavity and the piston 2024 are dynamically sealed; the piston 2024 separates the main cavity into an upper part and a lower part, to realize pressure isolation and ensure the upper part and the lower part do not interfere with each other; the upper part is filled with seawater, while the lower part is filled with drilling fluid; when the pressure in the upper part and the pressure in the lower part are not equal to each other, the piston 2024 can move up or down under the differential pressure, and thereby the subsea wellhead pressure indicator 2026 moves up or down and the pressure in the pressure chamber 2027 is adjusted; the lower slider 2022 is fixed at the center of the bottom surface of the piston 2024, the upper slider 2025 is fixed at the center of the top surface of the piston 2024, the lower slider 2022 and the upper slider 2025 ensure that the piston 2024 can move up and down only; the spring 2023 is fitted over the lower slider 2022, the top surface of the spring 2023 is at the bottom surface of the piston 2024, and the bottom surface of the spring 2023 is at the bottom end surface of the main cavity of the subsea wellhead pressure indicating and adjusting device; the spring 2023 provides a buffer for the up-down movement of the piston 2024 and provides a preset force to compensate for the impact of the pressure in the pressure chamber 2027 on the equilibrium position of the piston 2024; the main cavity is arranged with an opening in its top part, which communicates with the external seawater and thereby ensures the upper cavity above the piston 2024 is filled with seawater and the pressure in the upper cavity is the hydrostatic pressure of seawater at the seabed; the subsea wellhead pressure indicator 2026 is fixed to the top surface of the piston 2024, protrudes through the opening arranged in the top part of the main cavity, has scale marks on it, and moves with the piston 2024, to indicate the position of the piston in the cavity of the subsea wellhead pressure indicating and adjusting device and thereby indicate the level of difference between the upper part above the piston and the lower part below the piston the indication can be observed by the underwater robot; the pressure chamber 2027 is a cylindrical shell with a sealed top end, the bottom end of the pressure chamber 2027 is fixed to the central part of the top surface of the subsea pressure controller casing 2021, the upper slider 2025 extends upwards into the pressure chamber, the piston is fixed to the top end of the upper slider 2025 to seal an upper space of the pressure chamber 2027, the upper space is filled with gas, while the lower space is not sealed, but communicates with the external seawater; an outlet of the subsea pressure controller 2027 is connected to an inlet of the pressure booster 203 through a hydraulic pipeline, and an outlet of the pressure booster 203 is connected to an inlet of a hydraulic control unit of the hydraulic throttle valve 107 through a hydraulic pipeline; the pressure booster 203 boosts the pressure to provide enough power to adjust the opening of the hydraulic throttle valve 107.

Figure 2:
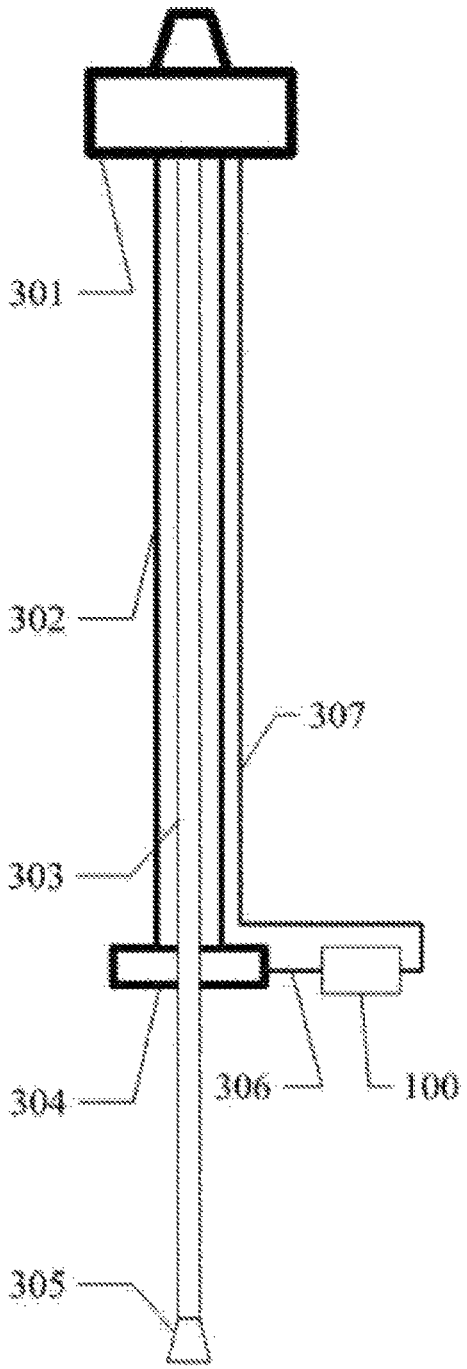
FIG. 2 is a schematic diagram of a deep-water dual-gradient drilling apparatus with the subsea wellhead pressure indicating and automatic adjusting device mounted on it.

As shown in FIG. 2, a deep-water dual-gradient drilling apparatus mounted with the subsea wellhead pressure indicating and automatic adjusting device for deep-water dual-gradient drilling described above comprises a floating drilling platform 301, a marine riser 302, a drilling stein 303, a subsea wellhead device 304, a drill bit 305, a drilling fluid discharge pipeline 306, and a drilling fluid return pipeline 307.

The floating drilling platform 301 is at the sea level, the subsea wellhead device 304 is at the mud line, the marine riser 302 is suspended below the floating drilling platform 301, the lower end of the marine riser 302 is connected to the subsea wellhead device 304, the drilling stein 303 passes through the marine riser 302 and the subsea wellhead device 304, the drill bit 305 is mounted at the bottom end of the drilling stein 303, the subsea wellhead device 304 is connected to the inlet of the first tee joint 101 of the subsea wellhead pressure indicating and automatic adjusting device for deep-water dual-gradient drilling 100 through the drilling fluid discharge pipeline 306, and the outlet of the subsea mud pump 109 of the subsea wellhead pressure indicating and automatic adjusting device for deep-water dual-gradient drilling 100 is connected to the floating drilling platform 301 through the drilling fluid return pipeline 307.

The floating drilling platform 301 provides a working space for pressure controlled drilling operation; the marine riser 302 provides a channel for the drilling stein 303 to move up and down, the seawater in the marine riser 302 maintains pressure balance between the interior and the exterior of the marine riser 302 to prevent the marine riser 302 from being damaged under the action of seawater pressure; the drilling stein 303 lifts up and lowers down the drill bit 305, the drill bit 305 drills in the formation; the subsea wellhead device 304 includes in a subsea wellhead, a blowout preventer unit, a solid particle handler, and a rotary flow divider, wherein a drilling fluid outlet is arranged below the rotary flow divider to split the drilling fluid from the lower wellbore, so that the drilling fluid flows to the subsea wellhead pressure indicating and automatic adjusting device 100 for deep-water dual-gradient drilling; the drilling fluid discharge pipeline 306 provides a flow channel for the drilling fluid discharged from the wellbore; the subsea wellhead pressure indicating and automatic adjusting device 100 for deep-water dual-gradient drilling adjusts the subsea wellhead pressure automatically; and the drilling fluid return pipeline 307 provides a flow channel for the drilling fluid to return to the floating drilling platform 301.

During deep-water dual-gradient drilling, an annular space formed by the marine riser 302 above the subsea wellhead device 304 and the drilling stein 303 is filled with seawater; the drilling fluid from the floating drilling platform 301 reaches to the downhole drill bit 305 through the drilling stein 303, flows out, enters the annular space formed by the drilling stein 303 and the wellbore and returns upwards carrying the rock cuttings.

When the returning drilling fluid reaches the mud line, it flows through a cyclone separator in the subsea wellhead device 304 into the subsea drilling fluid manifold system; the pipeline mounted with the first flat gate valve 102 is the working pipeline, while the pipeline mounted with the second flat gate valve 103 is a standby pipeline;

During normal deep-water dual-gradient drilling, the first flat gate valve 102 is in open state, the second flat gate valve 103 is in closed state, and the drilling fluid flows through the pipeline mounted with the first flat gate valve 102; in case the subsea wellhead pressure indicating and automatic adjusting system fails or in any other accidental circumstance, the first flat gate valve 102 can be closed and the second flat gate valve 103 can be opened by an underwater robot, so that the drilling fluid flows through the pipeline mounted with the second flat gate valve 103.

During normal deep-water dual-gradient drilling, the first pressure gauge 104 displays subsea wellhead pressure; the returning drilling fluid flows through the pipeline mounted with the first flat gate valve 102 into the cavity below the piston 2024 of the subsea wellhead pressure indicating and automatic adjusting system, to ensure the pressure in the cavity is the subsea wellhead pressure, which is denoted as $P_1$; the seawater flows through the opening in the top part of the subsea pressure controller casing 106 into the cavity above the piston 2024 of the subsea wellhead pressure indicating and automatic adjusting system, to ensure the pressure in the cavity is the hydrostatic pressure of seawater at the seabed, which is denoted as $P_2$.

If $P_1$ is greater than $P_2$, it indicates that the subsea wellhead pressure exceeds the hydrostatic pressure of seawater at the seabed. In this case, the pressure in the upper part above the piston 2024 and the pressure in the lower part below the piston 2024 are not equal to each other, specifically, the pressure in the upper part is lower than the pressure in the lower part, the piston 2024 moves upwards under the differential pressure and drives the subsea wellhead pressure indicator 2026 to move upwards together. As a result, the exposed length of the subsea wellhead pressure indicator 2026 increases, indicating that the subsea wellhead pressure is too high. The upper slider 2025 is also driven by the piston 2024 to move upwards to compresses the gas in the pressure chamber 2027, so that the pressure in the pressure chamber 2027 is increased. The pressure in the pressure chamber 2027 is transferred through the hydraulic pipeline to the pressure booster 203, whereby the hydraulic control unit of the hydraulic throttle valve 107 is actuated. As a result, the opening of the hydraulic throttle valve 107 is increased, the throttle pressure drop is decreased, the drilling fluid flow is increased, and thereby $P_1$ is decreased towards $P_2$ until they are equal to each other;

If $P_1$ is smaller than $P_2$, it indicates that the subsea wellhead pressure is lower than the hydrostatic pressure of seawater at the seabed. In this case, the pressure in the upper part above the piston 2024 and the pressure in the lower part below the piston 2024 are not equal to each other, specifically, the pressure in the upper part is higher than the pressure in the lower part, the piston 2024 moves downwards under the differential pressure, and drives the subsea wellhead pressure indicator 2026 to move downwards together. As a result, the exposed length of the subsea wellhead pressure indicator 2026 decreases, indicating that the subsea wellhead pressure is too low. The upper slider 2025 is also driven by the piston 2024 to move downwards, resulting in gas expansion in the pressure chamber 2027, so that the pressure in the pressure chamber 2027 is decreased. The pressure in the pressure chamber 2027 is transferred through the hydraulic pipeline to the pressure booster 203, whereby the hydraulic control unit of the hydraulic throttle valve 107 is actuated. As a result, the opening of the hydraulic throttle valve 107 is decreased, the throttle pressure drop is increased, the drilling fluid flow is reduced, and thereby $P_1$ is increased towards $P_2$ until they are equal to each other;

If $P_1$ is equal to $P_2$, it means that the subsea wellhead pressure is equal to the hydrostatic pressure of seawater at the seabed. In this case, the pressure in the upper part above the piston 2024 and the pressure in the lower part below the piston 2024 are equal to each other. As a result, the position of the piston 2024, the exposed length of the subsea wellhead pressure indicator 2026, as well as the opening of the hydraulic throttle valve 107 will not change, and the throttle pressure drop and the drilling fluid flow will be maintained;

The check valve 108 in the subsea drilling fluid manifold system ensures backflow of the drilling fluid will not occur; the second pressure gauge 110 displays the inlet pressure of the subsea mud pump 109, which can be observed by the subsea robot; the returning drilling fluid returns along the drilling fluid return pipeline 307 to the floating drilling platform 301 under the action of the subsea mud pump 109; after necessary operations, such as solid particle removal, etc., the drilling fluid is injected into the drilling stein 303 again, and thereby the drilling fluid is circulated; thus, safe dual-gradient drilling is realized.

What is claimed is:

1. A subsea wellhead pressure indicating and automatic adjusting device for deep-water dual-gradient drilling, comprising: a subsea drilling fluid manifold system and a subsea wellhead pressure indicating and automatic adjusting system, wherein the subsea drilling fluid manifold system provides a flow channel for the drilling fluid returning through a wellbore so that the drilling fluid is configured to smoothly return to a drilling platform, and provides a basis for the subsea wellhead pressure indicating and automatic adjusting system; and wherein the subsea wellhead pressure indicating and automatic adjusting system is configured to display and to adjust the subsea wellhead pressure in real time, in order to keep the subsea wellhead pressure to be constantly equal to a hydrostatic pressure of seawater at seabed, ensuring successful implementation of the dual-gradient drilling, wherein the subsea drilling fluid manifold system comprises: a first tee joint, a first flat gate valve, a second flat gate valve, a first pressure gauge, a second tee joint, a third tee joint, a hydraulic throttle valve, a check valve, a subsea mud pump, and a second pressure gauge, wherein an inlet of the first tee joint is connected to a subsea wellhead device through a drilling fluid discharge pipeline, a first outlet of the first tee joint is connected to an inlet of the first flat gate valve through a pipeline, an outlet of the first flat gate valve is connected to an inlet of the second tee joint through a pipeline on which the first pressure gauge is arranged, and a first outlet of the second tee joint is connected to a first inlet of the third tee joint through a pipeline; a second outlet of the first tee joint is connected to an inlet of the second flat gate valve through a pipeline, and an outlet of the second flat gate valve is connected to a second inlet of the third tee joint through a pipeline; an outlet of the third tee joint is connect to a fluid inlet of the hydraulic throttle valve through a pipeline, a fluid outlet of the hydraulic throttle valve is connected to an inlet of the check valve through a pipeline, an outlet of the check valve is connected to an inlet of the subsea mud pump through a pipeline on which the second pressure gauge is arranged, and an outlet of the subsea mud pump is connected to the drilling platform through a drilling fluid return pipeline.

2. The subsea wellhead pressure indicating and automatic adjusting device for deep-water dual-gradient drilling according to claim 1, wherein the subsea wellhead pressure indicating and automatic adjusting system comprises: a rock cuttings filter, a subsea pressure controller, and a pressure booster, wherein an inlet of the rock cuttings filter is connected to a second outlet of the second tee joint through a pipeline, and an inlet of the subsea pressure controller is connected to an outlet of the rock cuttings filter through a pipeline; an outlet of the subsea pressure controller is connected to an inlet of the pressure booster through a hydraulic pipeline, and an outlet of the pressure booster is connected to an inlet of a hydraulic control unit of the hydraulic throttle valve through a hydraulic pipeline.

3. The subsea wellhead pressure indicating and automatic adjusting device for deep-water dual-gradient drilling according to claim 2, wherein the subsea pressure controller includes a subsea pressure controller casing, a lower slider, a spring, a piston, an upper slider, a subsea wellhead pressure indicator, and a pressure chamber; the upper end and the lower end of the subsea pressure controller casing have the same outer diameter, which is smaller than the outer diameter of the middle part of the subsea pressure controller casing; the upper end and the lower end are arranged with a hole respectively for the upper slider and the lower slider to slide up and down, wherein the hole for the lower slider to slide forms the inlet of the subsea pressure controller; the inner diameter of the middle part is larger than the outer diameter of the upper end and of the lower end, the subsea pressure controller casing forms a main cavity of the subsea wellhead pressure indicating and adjusting device, the piston is arranged in the main cavity, and the main cavity and the piston are dynamically sealed; the main cavity is separated by the piston into an upper part and a lower part to realize pressure isolation, wherein the upper part is filled with seawater, while the lower part is filled with drilling fluid; the lower slider is fixed at the center of the bottom surface of the piston, and the upper slider is fixed at the center of the top surface of the piston; the spring is fitted over the lower slider, the top surface of the spring is at the bottom surface of the piston, and the bottom surface of the spring is at the bottom surface of the main cavity of the subsea wellhead pressure indicating and adjusting device; the top part of the main cavity is arranged with an opening, the subsea wellhead pressure indicator is fixed to the top surface of the piston, protrudes through the opening arranged on the top part of the main cavity, has scale marks on it, and moves with the piston, to indicate the position of the piston in the cavity of the subsea wellhead pressure indicating and adjusting device; the pressure chamber is a cylindrical shell with a sealed top end, the bottom end of the pressure chamber is fixed to the central part of the top surface of the subsea pressure controller casing, the upper slider extends upwards into the pressure chamber, a piston is fixed to the top end of the upper slider to seal an upper space of the pressure chamber, the upper space is filled with a gas, while the lower space is not sealed, but communicates with the external seawater; the top end of the pressure chamber is arranged with the outlet of the subsea pressure controller.

4. The subsea wellhead pressure indicating and automatic adjusting device for deep-water dual-gradient drilling according to claim 3, wherein, the rock cuttings filter has a built-in filter screen, the mesh size of which is smaller than the particle size of solid particles handled by a solid particle handler for deep-water dual-gradient drilling.

5. A deep-water dual-gradient drilling apparatus installed with a subsea wellhead pressure indicating and automatic adjusting device for deep-water dual-gradient drilling, said subsea wellhead pressure indicating and automatic adjusting device for deep-water dual-gradient drilling comprising: a subsea drilling fluid manifold system and a subsea wellhead pressure indicating and automatic adjusting system, wherein the subsea drilling fluid manifold system provides a flow channel for the drilling fluid returning through a wellbore so that the drilling fluid is configured to smoothly return to a drilling platform, and provides a basis for the subsea wellhead pressure indicating and automatic adjusting system; and wherein the subsea wellhead pressure indicating and automatic adjusting system is configured to display and to adjust the subsea wellhead pressure in real time, in order to keep the subsea wellhead pressure to be constantly equal to a hydrostatic pressure of seawater at seabed, ensuring successful implementation of the dual-gradient drilling;

said deep-water dual-gradient drilling apparatus comprising: the drilling platform, a marine riser, a drilling stem, a subsea wellhead device, a drill bit, a drilling fluid discharge pipeline, and a drilling fluid return pipeline, wherein the drilling platform is at sea level, the subsea wellhead device is at a mud line, the marine riser is suspended below the drilling platform, a lower end of the marine riser is connected to the subsea wellhead device, the drilling stem passes through the marine riser and the subsea wellhead device, the drill bit is mounted at a bottom end of the drilling stem, the subsea wellhead device is connected to an inlet of a first tee joint of the subsea wellhead pressure indicating and automatic adjusting device for deep-water dual-gradient drilling through the drilling fluid discharge pipeline, and an outlet of a subsea mud pump of the subsea wellhead pressure indicating and automatic adjusting device for deep-water dual-gradient drilling is connected to the drilling platform through the drilling fluid return pipeline, wherein the subsea drilling fluid manifold system comprises: the first tee joint, a first flat gate valve, a second flat gate valve, a first pressure gauge, a second tee joint, a third tee joint, a hydraulic throttle valve, a check valve, the subsea mud pump, and a second pressure gauge, wherein the inlet of the first tee joint is connected to the subsea wellhead device through the drilling fluid discharge pipeline, a first outlet of the first tee joint is connected to an inlet of the first flat gate valve through a pipeline, an outlet of the first flat gate valve is connected to an inlet of the second tee joint through a pipeline on which the first pressure gauge is arranged, and a first outlet of the second tee joint is connected to a first inlet of the third tee joint through a pipeline; a second outlet of the first tee joint is connected to an inlet of the second flat gate valve through a pipeline, and the outlet of the second flat gate valve is connected to a second inlet of the third tee joint through a pipeline; an outlet of the third tee joint is connect to a fluid inlet of the hydraulic throttle valve through a pipeline, a fluid outlet of the hydraulic throttle valve is connected to an inlet of the check valve through a pipeline, an outlet of the check valve is connected to an inlet of the subsea mud pump through a pipeline on which the second pressure gauge is arranged, and the outlet of the subsea mud pump is connected to the drilling platform through the drilling fluid return pipeline.

6. A deep-water dual-gradient drilling apparatus according to claim 5, wherein the subsea wellhead pressure indicating and automatic adjusting system comprises: a rock cuttings filter, a subsea pressure controller, and a pressure booster, wherein an inlet of the rock cuttings filter is connected to a second outlet of the second tee joint through a pipeline, and an inlet of the subsea pressure controller is connected to an outlet of the rock cuttings filter through a pipeline; an outlet of the subsea pressure controller is connected to an inlet of the pressure booster through a hydraulic pipeline, and an outlet of the pressure booster is connected to an inlet of a hydraulic control unit of the hydraulic throttle valve through a hydraulic pipeline.

7. A deep-water dual-gradient drilling apparatus according to claim 6, wherein the subsea pressure controller includes a subsea pressure controller casing, a lower slider, a spring, a piston, an upper slider, a subsea wellhead pressure indicator, and a pressure chamber; the upper end and the lower end of the subsea pressure controller casing have the same outer diameter, which is smaller than the outer diameter of the middle part of the subsea pressure controller casing; the upper end and the lower end are arranged with a hole respectively for the upper slider and the lower slider to slide up and down, wherein the hole for the lower slider to slide forms the inlet of the subsea pressure controller; the inner diameter of the middle part is larger than the outer diameter of the upper end and of the lower end, the subsea pressure controller casing forms a main cavity of the subsea wellhead pressure indicating and adjusting device, the piston is arranged in the main cavity, and the main cavity and the piston are dynamically sealed; the main cavity is separated by the piston into an upper part and a lower part to realize pressure isolation, wherein the upper part is filled with seawater, while the lower part is filled with drilling fluid; the lower slider is fixed at the center of the bottom surface of the piston, and the upper slider is fixed at the center of the top surface of the piston; the spring is fitted over the lower slider, the top surface of the spring is at the bottom surface of the piston, and the bottom surface of the spring is at the bottom surface of the main cavity of the subsea wellhead pressure indicating and adjusting device; the top part of the main cavity is arranged with an opening, the subsea wellhead pressure indicator is fixed to the top surface of the piston, protrudes through the opening arranged on the top part of the main cavity, has scale marks on it, and moves with the piston, to indicate the position of the piston in the cavity of the subsea wellhead pressure indicating and adjusting device; the pressure chamber is a cylindrical shell with a sealed top end, the bottom end of the pressure chamber is fixed to the central part of the top surface of the subsea pressure controller casing, the upper slider extends upwards into the pressure chamber, a piston is fixed to the top end of the upper slider to seal an upper space of the pressure chamber, the upper space is filled with a gas, while the lower space is not sealed, but communicates with the external seawater; the top end of the pressure chamber is arranged with the outlet of the subsea pressure controller.

8. A deep-water dual-gradient drilling apparatus according to claim 7, wherein the rock cuttings filter has a built-in filter screen, the mesh size of which is smaller than the particle size of solid particles handled by a solid particle handler for deep-water dual-gradient drilling.

* * * * *